US007479067B2

(12) United States Patent
Gibson et al.

(10) Patent No.: US 7,479,067 B2
(45) Date of Patent: Jan. 20, 2009

(54) GOLF MARKER AND METHOD OF USE

(75) Inventors: Lee G. Gibson, 2001 Peel Rd., Montgomery, TX (US) 77356; Henry G. Clay, Jr., Springfield, MA (US)

(73) Assignee: Lee G. Gibson, Montgomery, TX (US)

( * ) Notice: Subject to any disclaimer, the term of this patent is extended or adjusted under 35 U.S.C. 154(b) by 30 days.

(21) Appl. No.: 11/519,707

(22) Filed: Sep. 12, 2006

(65) Prior Publication Data

US 2008/0064518 A1 Mar. 13, 2008

(51) Int. Cl.
*A63B 57/00* (2006.01)

(52) U.S. Cl. ..... 473/150; 52/104; 116/209

(58) Field of Classification Search ..... 473/131, 473/150, 405–407; 116/209; 52/103, 104; 40/661

See application file for complete search history.

(56) References Cited

U.S. PATENT DOCUMENTS

| | | | | | |
|---|---|---|---|---|---|
| 165,147 | A | * | 7/1875 | Baldwin | 40/584 |
| 885,850 | A | * | 4/1908 | Josenhans | 52/104 |
| 1,689,865 | A | * | 10/1928 | Davis et al. | 40/505 |
| 2,013,377 | A | * | 9/1935 | Debs | 52/104 |
| 2,124,143 | A | * | 7/1938 | Long | 52/104 |
| 2,548,706 | A | * | 4/1951 | Corning | 40/661 |
| 2,800,099 | A | * | 7/1957 | Baker | 116/63 R |
| 3,107,848 | A | * | 10/1963 | Penta | 232/17 |
| 3,561,146 | A | * | 2/1971 | Dembar | 40/720 |
| 3,599,981 | A | * | 8/1971 | Zausmer | 473/150 |
| 3,685,168 | A | * | 8/1972 | Reitz | 434/252 |
| 3,774,332 | A | * | 11/1973 | Schneider | 40/720 |
| 4,054,000 | A | * | 10/1977 | Lisle | 40/124.5 |
| 4,144,682 | A | * | 3/1979 | Cousin | 52/103 |
| 4,195,729 | A | * | 4/1980 | Macken | 206/216 |
| 4,244,512 | A | * | 1/1981 | Wise | 232/17 |
| 4,489,669 | A | * | 12/1984 | Carman | 116/202 |
| 4,854,060 | A | * | 8/1989 | Corbo et al. | 40/720 |
| 4,946,039 | A | * | 8/1990 | Garran | 206/575 |
| 4,991,769 | A | * | 2/1991 | Todd | 232/17 |
| 5,077,925 | A | * | 1/1992 | Herrera et al. | 40/642.02 |
| 5,263,262 | A | * | 11/1993 | Steere, Jr. | 33/700 |
| 5,332,093 | A | * | 7/1994 | Littlepage | 206/457 |
| 5,356,134 | A | * | 10/1994 | DeMatteo | 473/150 |
| D361,890 | S | * | 9/1995 | Littlepage | D3/271.6 |
| 5,464,219 | A | * | 11/1995 | Bradford et al. | 473/150 |
| 5,497,988 | A | * | 3/1996 | Tolley et al. | 473/150 |
| 5,532,677 | A | * | 7/1996 | Miller | 340/286.01 |
| 5,593,156 | A | * | 1/1997 | Jambor | 40/584 |
| 5,769,731 | A | * | 6/1998 | Reimer | 473/150 |
| 5,860,876 | A | * | 1/1999 | Rich Guffey, et al. | 473/405 |
| 6,256,914 | B1 | * | 7/2001 | Yeh | 40/720 |
| 6,474,543 | B2 | * | 11/2002 | Grell | 232/38 |
| D467,436 | S | * | 12/2002 | Fink | D6/300 |

(Continued)

*Primary Examiner*—Mark S Graham
(74) *Attorney, Agent, or Firm*—Buskop Law Group, P.C.; Wendy Buskop

(57) ABSTRACT

A marker for a golf course and a method for using the marker that can have a changeable message. The marker can have a transparent plastic outer body, a display means, a changeable message and an anchoring device. There can also be an adhesive pad that can connect the anchoring device to the transparent plastic outer body. The display means can be visible through eh transparent foldable plastic outer body.

28 Claims, 10 Drawing Sheets

U.S. PATENT DOCUMENTS 6,493,972 B1 * 12/2002 Williams ..... 40/454
6,746,337 B1 * 6/2004 Tipaldo ..... 473/150
6,925,740 B2 * 8/2005 Shannon ..... 40/124.5
7,150,681 B2 * 12/2006 Nilsson ..... 473/150
7,234,258 B2 * 6/2007 Nielson ..... 40/661
7,350,691 B2 * 4/2008 Monette et al. ..... 232/38
2004/0254025 A1 * 12/2004 Frumin et al. ..... 473/131
2005/0257444 A1 * 11/2005 Timms ..... 52/104
2006/0148595 A1 * 7/2006 Bostock ..... 473/407

* cited by examiner

GOLF MARKER AND METHOD OF USE

FIELD

The embodiments involve marketing and advertising at a golf course by use of markers.

BACKGROUND

It is known to locate a golf course marker in the ground to delineate a path, to indicate distance to an object, or to convey information (such as a historical plaque). At golf courses for instance, tee-markers are typically used to indicate where a golfer is to tee off, distance markers typically indicate the distance from the marker to the centre of the green, and hole markers identify the whole layout and play characteristics. A need exists for a golf course marker with replaceable advertising that is weather resistant to withstand rain showers and sprinkler activations.

One type of golf course marker often used at golf courses is a colored stake, or another identifiable indicator, protruding from the ground a predetermined distance (usually 150 yards) from the centre of the green. The golfer estimates by eye, or paces off, the distance between his ball and the distance marker or hole marker to determine how far his ball is from the centre of the green. The golfer is then better able to decide on the appropriate club to use to hit the ball on to the green. There exists a need where an amount of information can be placed on a golf course marker.

Another type of golf course marker used on golf courses is a cement slab located generally flush with the ground along the centre line of the fairway, along the cart path, or along the edge of the fairway, also known as a distance marker. Such golf course markers may be color-coded and located at predetermined distances along the fairway. For instance, a red slab may be located at 100 yards, a white slab at 150 yards, and a blue slab at 200 yards. A problem with the golf course markers are that they tend to be fixed, and not functional for advertising as they are small and not high from the group. In addition, golf course markers can cause damage to other pieces of golf course equipment, such as aerating machines, mowing equipment or golf carts. A need exists for a replaceable golf course marker that if run over, would not damage golf equipment or cause minimal damage, yet would still be viewable to players and maintenance crews and spectators.

A need exists for golf course markers that are viewable by television cameras for needed product placement advertising during a televised golf game.

A need exists for a reusable golf course marker with a changeable message that is weather resistant.

A need exists for a method of displaying graphics that is inexpensive and conveniently changeable on a golf course as well as being able to be manufactured and delivered quickly.

The present embodiments meets these needs.

BRIEF DESCRIPTION OF THE DRAWINGS

The detailed description will be better understood in conjunction with the accompanying drawings as follows.

Figure 1:
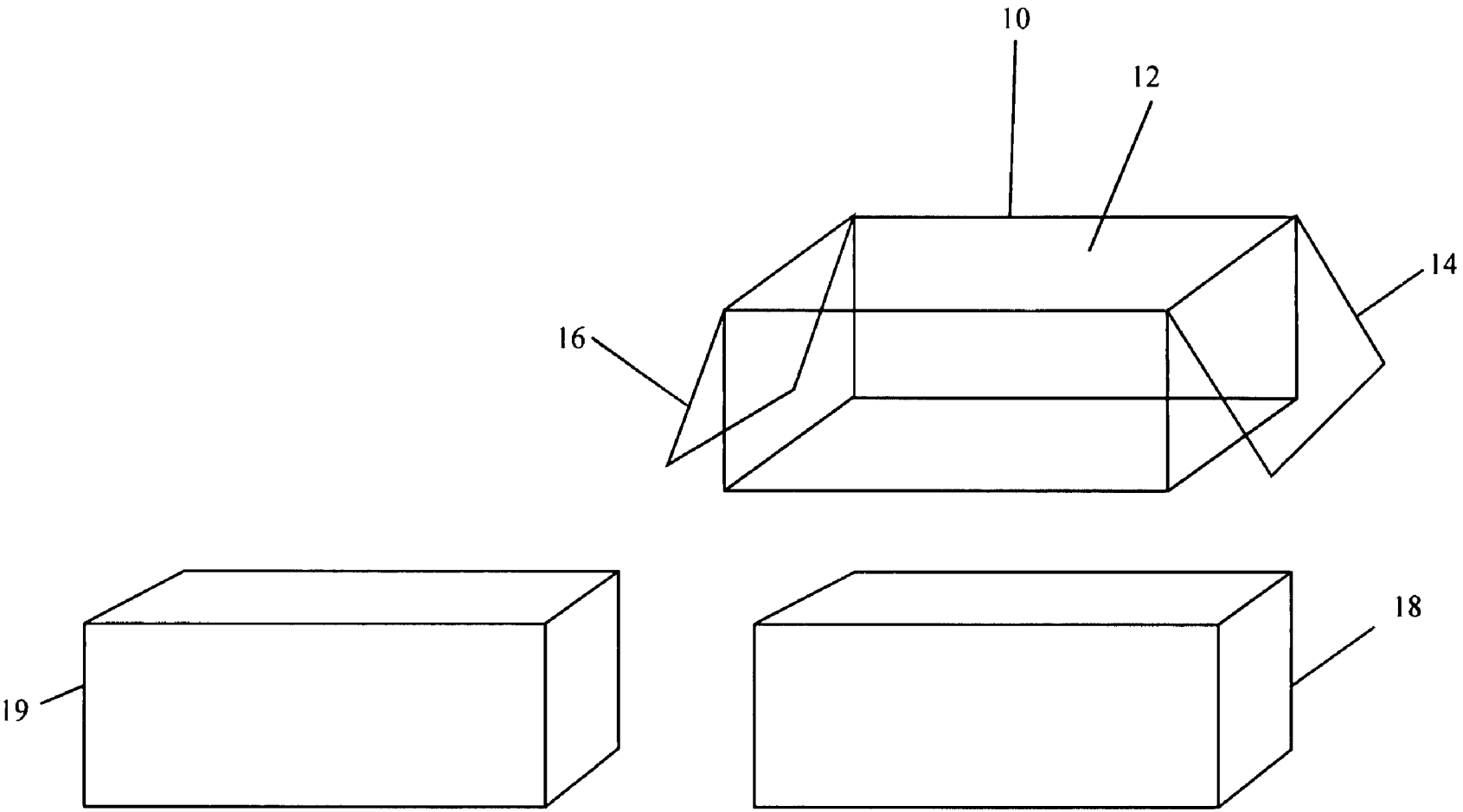
FIG. 1 shows an exploded perspective embodiment of the invention.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

Golf course markers and markers are defined as any type of distance marker, hole marker, play marker, informational marker or tee-marker on a golf course.

The present embodiments permits the usage of advertising on a golf course. The current invention helps advertisers customize a message for a particular audience. Noting that on any particular day the golf course may have an audience that has a particular commonality, ie a tournament for CPA's.

The current invention can allow golf ball manufacturers to package the golf balls in a packaging that will allow the packaging to be easily convertible into a marker. By doing so markers can be part of the golf ball packaging and golf balls can have packaging that can be used as markers.

The current invention helps advertisers by allowing the graphics on the markers to be easily changeable.

The golf course venue offers an opportunity for a business, a group, an individual, or any entity to communicate efficiently with a targeted audience. Golf course markers provide an efficient and effective means of presenting visual communication.

Golf course makers also fill the need to make the players feel special and that this golf outing, event or tournament is special or more important because other courses may not have markers that have been made special just for their event. The markers help advertisers increase their adverting frequency for more effective advertising results. The markers provide greater sponsor visibility thereby enhancing the image of the tournament. The markers can help raise more money for the tournament organizer by providing better sponsor recognition and the opportunity to sell more sponsors.

The current invention allows markers to be made relatively inexpensively.

The current invention allows makers to have interchangeable, replaceable or layerable inserts with different graphics rendering them reusable.

The current invention allows markers that can be shipped flat for assembly on site allowing a cost savings of both freight and assembly for the purchaser.

The current invention allows markers that can be easily disassembled and stored flat saving space and adding convenience.

The current invention allows markers that can be used as part of the packaging to other products in particular golf balls which would be used on approximately the same date or at the same location.

The current invention allows markers that can be produced and shipped quickly which allows for a greater opportunity to sell the printing on the panels and hence increase revenue for both the tee-marker manufacturer and the tee-marker buyer that may be selling the advertising space on the panels.

The current invention allows markers that can be sold as component parts, as a kit or as a complete unit.

The current invention allows markers that can have their weather resistant graphics somewhat protected (weather resistant) from the moisture and UV sunlight.

Turning now to the figures, FIG. 1 shows a marker for a golf course. The marker has a transparent plastic outer body 10 with a top side 12 integrally connected to a folding first 14 and a folding second end 16. The entire transparent plastic outer body 10 can be foldable into a shape, which can be rectangular.

In one embodiment the transparent plastic can be made by vacuum forming or mold forming.

A display means 18 can be a box shape of the same size generally as the transparent plastic outer body, but slightly smaller so that it can fit within the transparent plastic outer body 10 and wherein the display means has substantially the same shape as the outer body. The display means 19 can be slidable inside the transparent plastic outer body. The display means creates a surface that can be visible through the transparent foldable plastic outer body.

A changeable message 19, such as a printed message wraps around the display means 18 and can be insertable over the display means 18 between the display means and the transparent plastic outer body.

The display means can be a hollow cardboard box, a polystyrene foam material, or a posterboard material.

Figure 2:
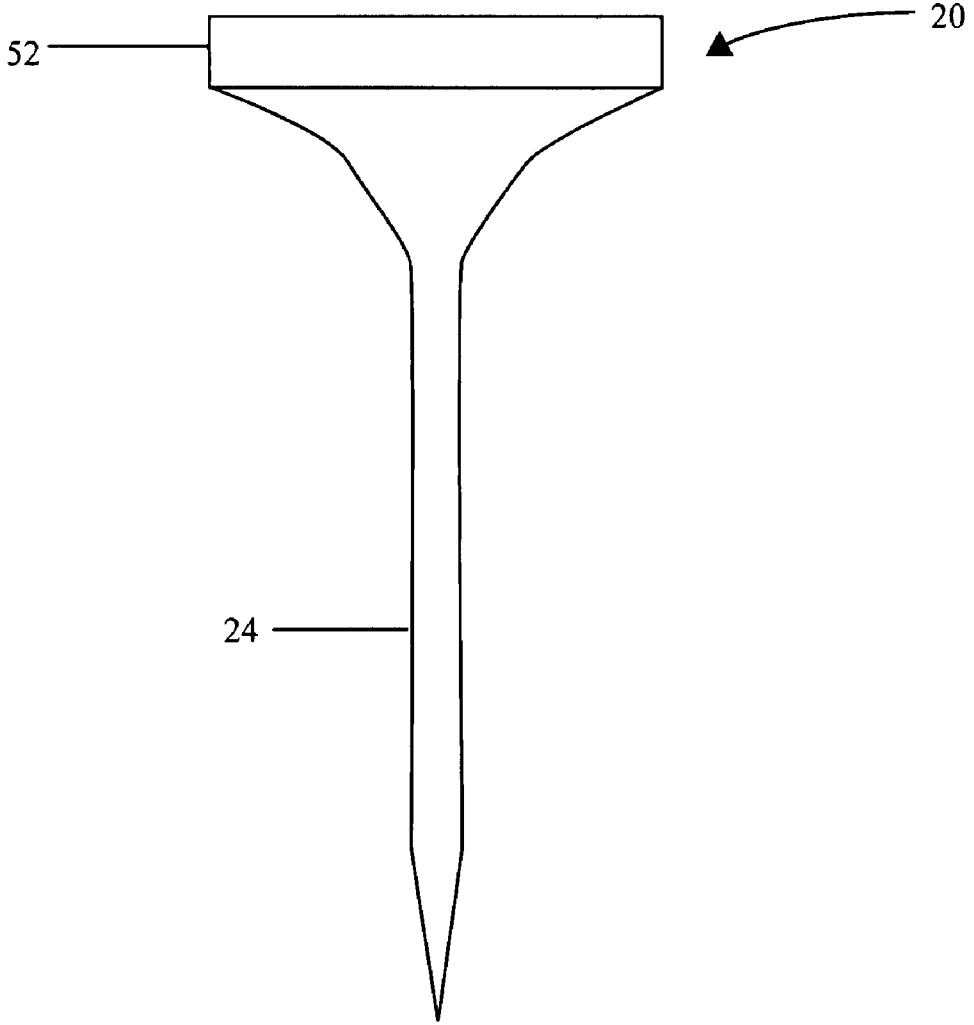
FIG. 2 shows a front exploded view of the embodiment of FIG. 1.

FIG. 2 shows the at least one anchoring device 20 having a head 52 and a shank 24 connected to the head, which can be adhered to the bottom face of the transparent plastic outer body. The at least one anchoring device 20 is used to engage a portion of a golf course when the anchoring device is adhered to the transparent plastic outer body with and adhesive pad that is shown in more detail in FIG. 3.

Figure 3:
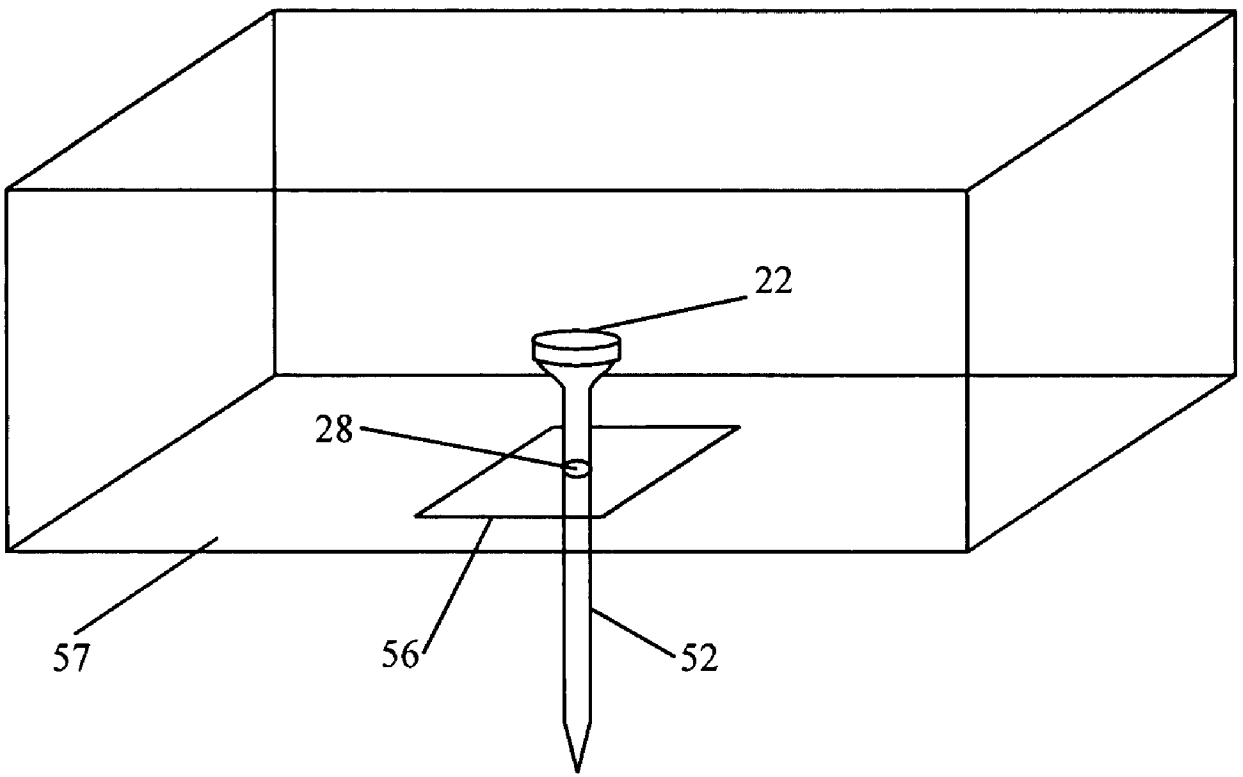
FIG. 3 is a bottom view of an embodiment of the invention.

FIG. 3 depicts an adhesive pad 56 for connecting the at least anchoring device removeably with the transparent plastic outer body on a bottom side 57 by enabling the head 52 to penetrate the adhesive pad 56 and for holding anchoring device securely to the transparent plastic outer body. The adhesive pad can have a hole pre-cut in the adhesive pad or the anchoring device can puncture the adhesive pad.

The anchoring device can be a golf tee, a nail, a spike, stake pin or cleat.

In the embodiment of FIG. 3, the adhesive pad has a hole 28 adapted to hold the head of the anchoring device against a bottom side 57 of the transparent plastic outer body while permitting the shank to protrude away from the transparent plastic outer body for penetration into the at least a portion of a golf course.

Figure 4:
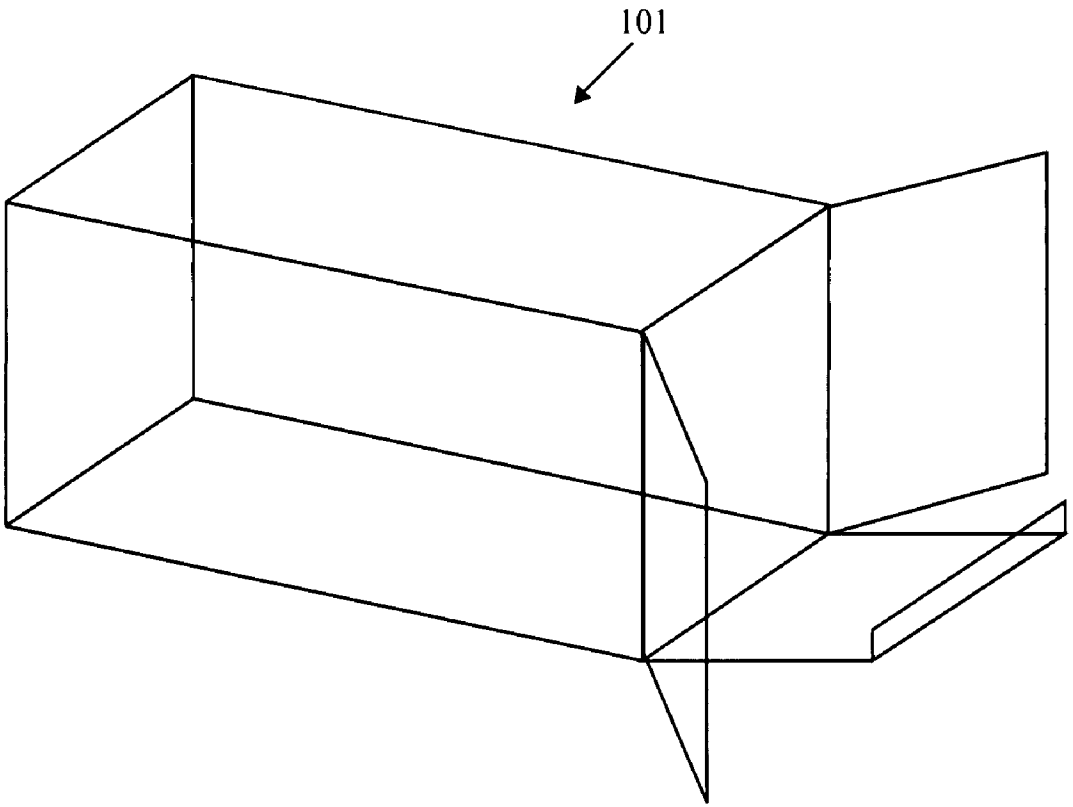
FIG. 4 is side view of the embodiment of FIG. 3.

In an embodiment, the transparent plastic outer body can be hollow comprising a shape consisting of four generally rectangular side walls and two generally square first and second ends. FIG. 4, element 101 depicts an end view showing the integral foldable end which is integral with the top of the marker.

Figure 5:
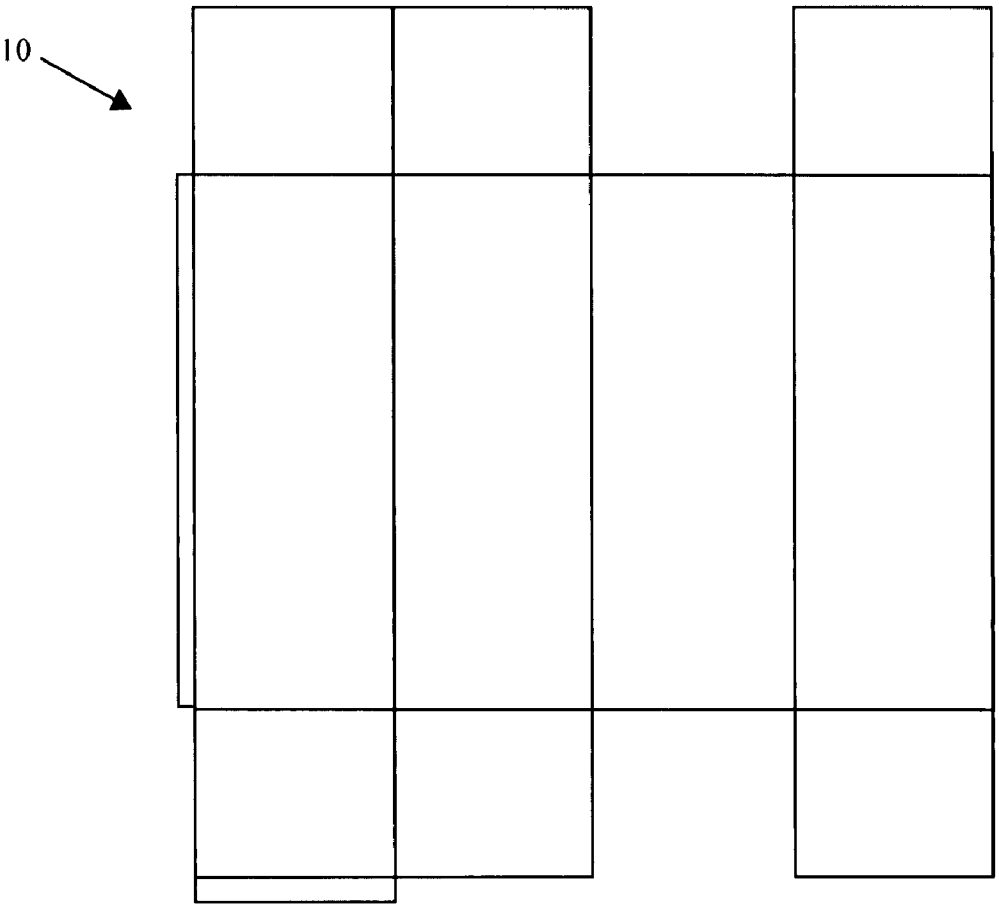
FIG. 5 shows a top view of the single sheet embodiment of the invention.

The embodiment of FIG. 1 contemplates that the transparent plastic outer body is formed from by folding a single sheet of foldable transparent plastic. FIG. 5 depicts an embodiment of the single sheet of foldable transparent plastic for forming the outer body 10.

In an embodiment the marker can include an anchoring device that can have a mass great enough so that it holds down the marker. By doing so, a weighted marker prevents the need to have deep protrusions into the golf course.

The single sheet of foldable transparent plastic can be 1/100th of an inch in thickness in an embodiment, and range from 1/100th to 1/25th of an inch in thickness.

It should be noted that the changeable message usable in the display means can be a customized message. The changeable message can include a graphic selected from the group consisting of pictures, designs, logos, icons, web-addresses, text, illustrations and combinations thereof.

In an embodiment, the shank of the anchoring device can be at least as long as a golf tee, when the anchoring device is adhered to the face of the transparent plastic of the outer body 10. However, the shank in other embodiments can range in length from 7 inches and 1 and ½ inches.

The invention contemplates that the display means can be a lightweight hollow cardboard box, or it can be made from a foam in a box shape. The foam can by Styrofoam or a closed cell elastomeric foam, similar to a sponge material.

The customized message can be printed on any of a variety of materials, including paper, vinyl, paperboard, polyethylene film, polyethylene sheet, or other flexible printable thin material.

The changeable message can be printed on any printable material that slips behind each face of the marker.

Still another embodiment contemplates that the assembled, folded marker with message can be further coated in a protective coating comprising varnish, polyurethane, or aqueous coating.

Figure 6:
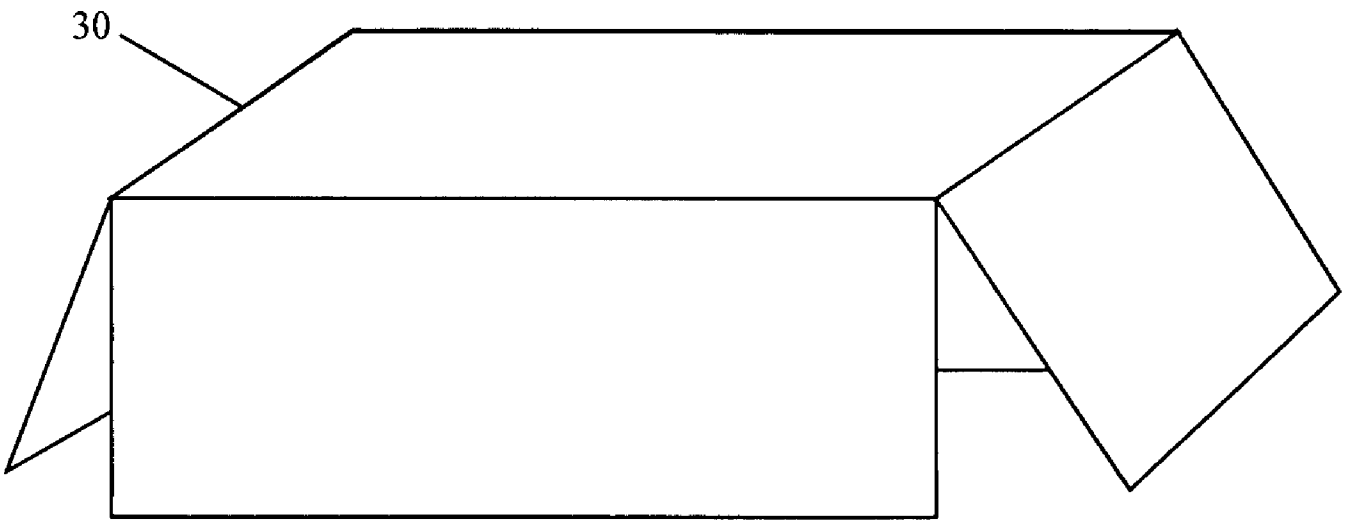
FIG. 6 shows an embodiment of the marker with a enveloping bag.

FIG. 6 shows an embodiment of the invention wherein the marker is disposed in a transparent flexible reusable sealable sleeve 30. The transparent flexible reusable sealable sleeve can be made from polystyrene, polyethylene, polypropylene, homopolymers and copolymers thereof.

The invention includes a method for presenting a message on a golf course, comprising the steps of: forming a reusable marker with a changeable message as described above and as shown in FIG. 1, then inserting the marker into the ground using the anchoring device.

A method of the invention contemplates using a pair of markers positioned on either side of a tee for presenting a changeable message during teeing off at a golf tournament and may be deemed part of the golf course or be deemed the markers which designate the teeing area to begin play on each hole.

Figure 7:
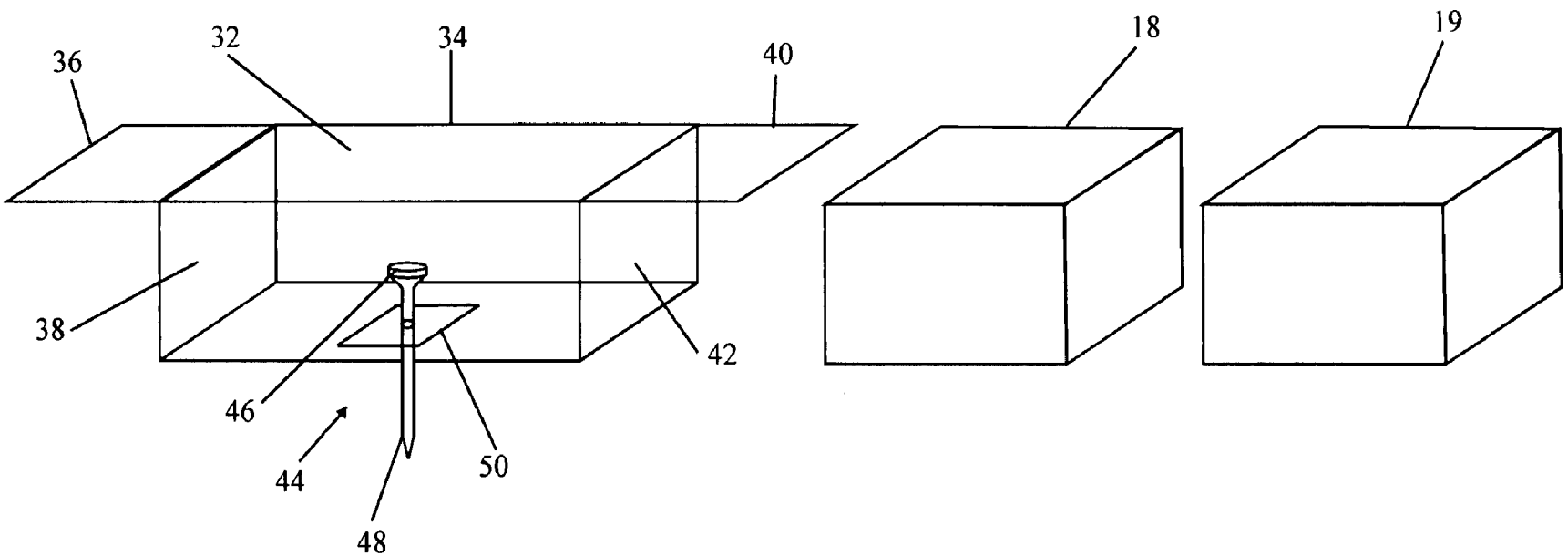
FIG. 7 shows another embodiment of the marker in an exploded perspective view.

Another embodiment of the marker is shown in FIG. 7, wherein a transparent plastic tube 32 is formed having a tube top side 34, into which is slid the display means 18 around which has been placed the changeable message 19. A first end cap 36 is removably connected around a first end 38 of the tube and a second end cap 40 is removably connected around a second end 42 of the tube.

Display means 18 adapted to slide within the transparent plastic tube 32 and wherein said display means has substantially the same shape as the transparent plastic tube.

In this FIG. 7, the adhesive pad is indicated as element 50 adheres an anchoring device removeably, to the tube enabling the marker to be placed securely on the golf course. This anchoring device 44 has a head 46 connected to a shank 48.

Figure 8:
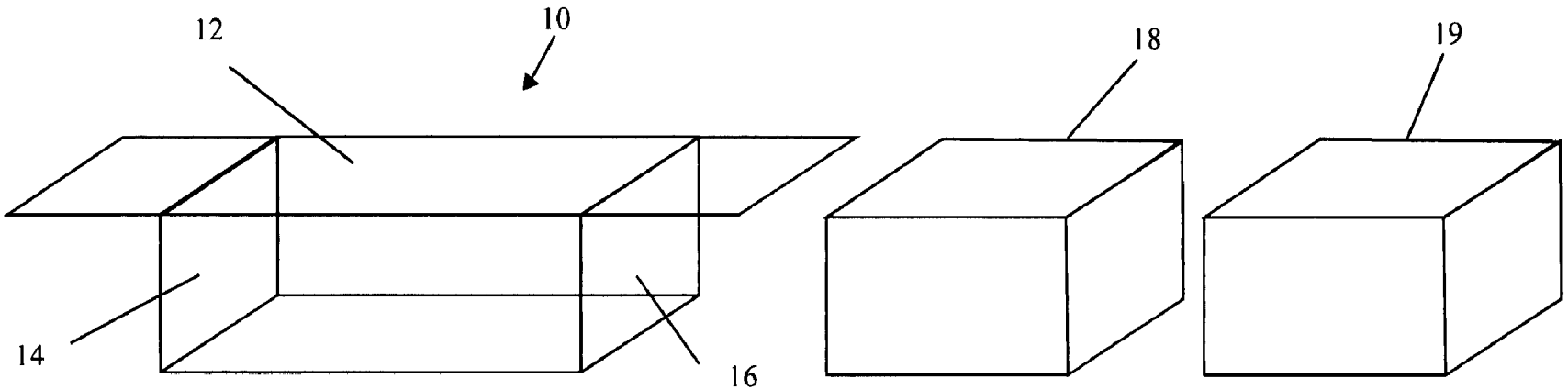
FIG. 8 shows an exploded perspective view of the five-sided box embodiment of the invention.

FIG. 8 shows an embodiment of the marker. In this Figure, the marker is formed from a transparent plastic outer body 10 foldable to form a five-sided box and having a top side 12 and an integral folding first end 14 and an integral folding second end 16.

Display means 18 slides into the five-sided box. The display means 18 has substantially the same shape as the five-sided box.

A changeable message 19 slides over the display means between the display means and the five-sided box.

Figure 9:
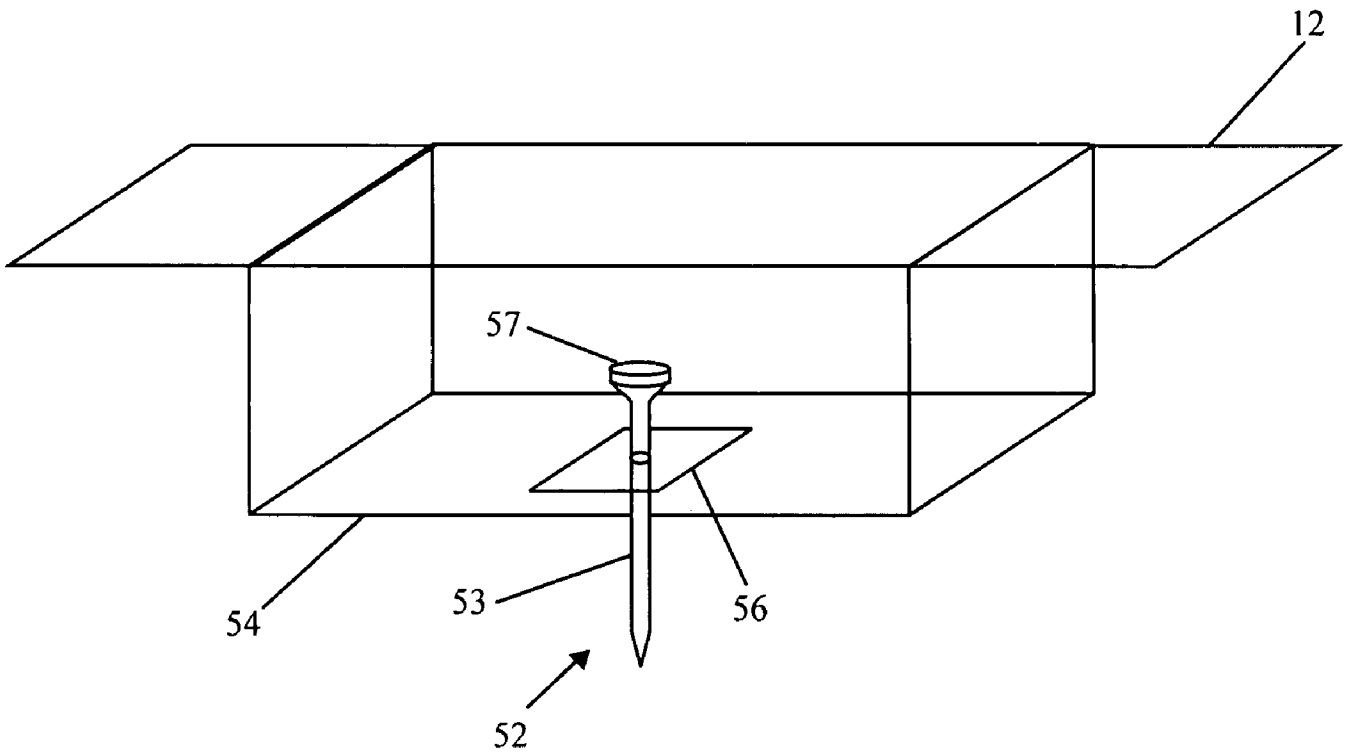
FIG. 9 shows a bottom view of the embodiment of FIG. 8.

FIG. 9 shows the anchoring device 52 of the embodiment of FIG. 8, In this bottom view the anchoring device is shown having a head 57 and a shank 53 connected to the head. The anchoring device is adhered to an underside 54 of the top side 12 of the five-sided box using an adhesive pad 56 for removeably connecting the anchoring device 52 to the underside 54 of the five-sided box.

In this embodiment, the shank 53 of the anchoring device is at least as long as the height of the five-sided box.

Figure 10:
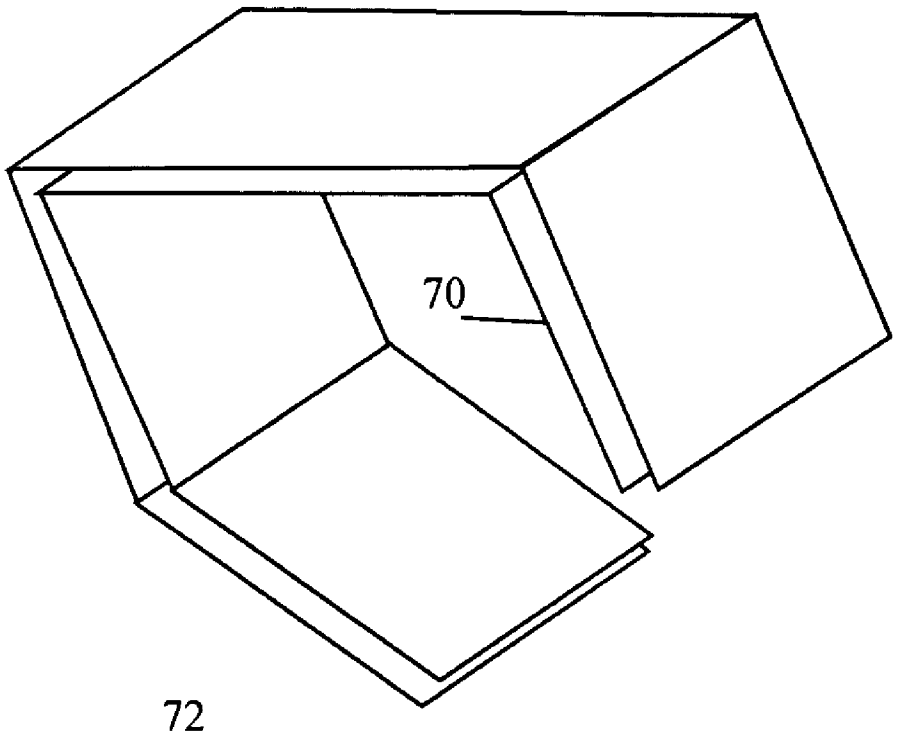
FIG. 10 shows a cross section of the laminated sheet usable to form the marker of the invention.

In still another embodiment, the marker can be made from a laminated sheet. FIG. 10 shows a side view of the laminated sheet having a message 70 encapsulated on top bottom and sides in a flexible clear protective coating 72. The laminated sheet is then foldable into at least a five-sided box, and an anchoring device having a head and a shank are connected to the at least five-sided box with an adhesive pad that can be a removable for removeably connecting the anchoring device to the marker box for securing to the ground of the golf course.

While these embodiments have been described with emphasis on the embodiments, it should be understood that within the scope of the appended claims, the embodiments might be practiced other than as specifically described herein.

What is claimed is:

1. A marker for a golf course comprising:

a transparent plastic outer body having a top side integrally connected to a folding first end and a folding second end;

a display means adapted to fit within the transparent plastic outer body and wherein the display means has the same shape as the outer body, and is slidable inside the outer body, the display means is visible through the transparent foldable plastic outer body;

a changeable message insertable over the display means, wherein the changeable message is between the display means and the transparent plastic outer body;

an at least one anchoring device having a head and a shank connected to the head, wherein the at least one anchoring device can engage a portion of a golf course.

2. The marker of claim 1, wherein the anchoring device comprises a weighted object to hold the marker onto the ground.

3. The marker of claim 1, wherein the anchoring device comprises of multiple shanks with a length from ½ inch to 1 inch.

4. The marker of claim 1, wherein the at least one anchoring device is a golf tee, a nail, a spike, a stake, a pin or a cleat.

5. The marker of claim 1, further comprising an adhesive pad for connecting the at least one anchoring device removably with the transparent plastic outer body for holding anchoring device securely to the transparent plastic outer body; and wherein the adhesive pad is adapted to hold the head of the anchoring device against a bottom side of the transparent plastic outer body while permitting the shank to protrude away from the transparent plastic outer body for penetration into a portion of the golf course.

6. The marker of claim 1, wherein the transparent plastic outer body is hollow comprising a shape consisting of four rectangular side walls and two square first and second ends.

7. The marker of claim 1, wherein the transparent plastic outer body is formed by folding a single sheet of foldable transparent plastic, vacuum forming or mold forming.

8. The marker of claim 1, wherein the changeable message presents a customized message.

9. The marker of claim 1, wherein the changeable message includes a graphic selected from the group consisting of pictures, designs, logos, icons, web-addresses, text, illustrations and combinations thereof.

10. The marker of claim 1, wherein the shank of the anchoring device is at least as long as a golf tee.

11. The marker of claim 8, wherein the shank has a length from ½ inch to 7 inch.

12. The marker of claim 1, wherein the display means comprises a hollow cardboard box, a polystyrene foam material, and a posterboard material formed into a box shape.

13. The marker of claim 1, wherein the customized message is printed on paper, vinyl, paperboard, polyethylene film, polyethylene sheet, or some other flexible printable thin material.

14. The marker of claim 1, wherein the marker is further coated in a protective coating comprising of varnish, polyurethane, or aqueous coating.

15. The marker of claim 1, wherein the marker is disposed in a transparent flexible reusable sealable sleeve.

16. The marker of claim 13, wherein the transparent flexible reusable sealable sleeve is made from a member of the group consisting of: polystyrene, polyethylene, polypropylene, homopolymers and copolymers thereof.

17. A marker comprising:

a transparent plastic outer body foldable to form a five-sided box and having a top side and an integral folding first end and an integral folding second end;

display means adapted to fit within the five-sided box and wherein the display means has substantially the same shape as the five-sided box, and is slidable inside the five-sided box;

a changeable message insertable over the display means and wherein the changeable message is insertable between the display means and the five-sided box;

an anchoring device having a head and a shank connected to the head, wherein the at least one anchoring device is adhered to an underside of the top side with an adhesive pad for removably connecting the at least one anchoring device to the five-sided box.

18. The marker of claim 17, wherein the at least one anchoring device is a golf tee, a nail, a spike, stake, pin or cleat.

19. The marker of claim 17, wherein the adhesive pad comprises a hole adapted to hold the head of the anchoring device against the underside of the top side while permitting the shank to protrude away from the five-sided box for penetration into a portion of the golf course.

20. The marker of claim 17, wherein the transparent plastic outer body is hollow comprising a shape consisting of four generally rectangular side walls and two generally square first and second ends.

21. The marker of claim 17, wherein the transparent plastic outer body is formed by folding a single sheet of foldable transparent plastic.

22. The marker of claim 17, wherein the changeable message presents a customized message.

23. The marker of claim 17, wherein the changeable message includes a graphic selected from the group consisting of pictures, designs, logos, icons, web-addresses, text, illustrations and combinations thereof.

24. The marker of claim 17, wherein the shank of the anchoring device is at least as long as the height of the five-sided box.

25. The marker of claim 17, wherein the display means is a hollow cardboard box or a foam box.

26. The marker of claim 17, wherein the customized message is on paper, vinyl, paperboard, polyethylene film, polyethylene sheet, or other flexible printable thin material.

27. The marker of claim 17, wherein the marker is further coated in a protective coating comprising varnish, polyurethane, or aqueous coating.

28. The marker of claim 17, wherein the transparent flexible reusable sealable sleeve is made from a member of the group consisting of: polystyrene, polyethylene, polypropylene, homopolymers and copolymers thereof.

* * * * *